US012709882B2

(12) United States Patent
Suliman

(10) Patent No.: US 12,709,882 B2
(45) Date of Patent: Aug. 18, 2026

(54) DEVICE FOR ADDING FLUID MEDIUM TO SHOWER SYSTEM, AND SHOWER SYSTEM

(71) Applicant: Magid Abdalla Suliman, Blackrock (IE)

(72) Inventor: Magid Abdalla Suliman, Blackrock (IE)

( * ) Notice: Subject to any disclaimer, the term of this patent is extended or adjusted under 35 U.S.C. 154(b) by 131 days.

(21) Appl. No.: 18/905,316

(22) Filed: Oct. 3, 2024

(65) Prior Publication Data

US 2025/0027304 A1 Jan. 23, 2025

Related U.S. Application Data

(63) Continuation-in-part of application No. 17/250,803, filed as application No. PCT/CN2019/112922 on Oct. 24, 2019, now Pat. No. 12,134,883.

(30) Foreign Application Priority Data

Nov. 1, 2018 (CN) ..... 201821794448.5

(51) Int. Cl.
*E03C 1/046* (2006.01)
*E03C 1/04* (2006.01)

(52) U.S. Cl.
CPC ..... *E03C 1/046* (2013.01); *E03C 1/0408* (2013.01)

(58) Field of Classification Search
CPC .... E03C 1/046; E03C 1/0465; E03C 2201/40; A47K 3/281
(Continued)

(56) References Cited

U.S. PATENT DOCUMENTS 4,218,013 A * 8/1980 Davison ..... E03C 1/046 4/605
9,022,073 B2 5/2015 Strauli
(Continued)

FOREIGN PATENT DOCUMENTS

CN 102918212 A 2/2013
CN 105258338 A 1/2016
(Continued)

OTHER PUBLICATIONS

International Search Report and Written Opinion in corresponding International Patent Application No. PCT/CN2019/112922 dated Jan. 22, 2020.
(Continued)

*Primary Examiner* — Tuan N Nguyen
(74) *Attorney, Agent, or Firm* — Westman, Champlin & Koehler, P.A.

(57) ABSTRACT

A device for adding a fluid medium to a shower system includes a water pipe assembly, a reservoir, a fluid medium pipe assembly and a valve body assembly. The reservoir includes a first chamber and a second chamber. The fluid medium pipe assembly includes a suction pipe and a switch valve, the suction pipe is provided with a fluid medium inlet and a fluid medium outlet, the fluid medium outlet is connected with the water pipe assembly, the suction pipe includes a communication portion, a first suction portion and a second suction portion, a first end of the first suction portion and a second end of the second suction portion form the fluid medium inlet, and a liquid outlet end of the communication portion forms the fluid medium outlet. The switch valve allows the communication portion to be selectively in communication with the first suction portion or second suction portion.

19 Claims, 11 Drawing Sheets

(58) Field of Classification Search
USPC ..... 4/903, DIG. 10, 597, 605, 661
See application file for complete search history.

(56) References Cited

U.S. PATENT DOCUMENTS

| | | | |
|---|---|---|---|
| 2012/0118414 | A1 | 5/2012 | McMurtry |
| 2015/0361645 | A1 | 12/2015 | Bonacci et al. |
| 2021/0189704 | A1 | 6/2021 | Suliman |

FOREIGN PATENT DOCUMENTS

| | | | | |
|---|---|---|---|---|
| CN | 205224186 | U | 5/2016 | |
| CN | 106419797 | A | 2/2017 | |
| WO | 200404007 | A1 | 5/2004 | |
| WO | WO-2004040071 | A1 * | 5/2004 | ..... E03C 1/046 |
| WO | 2020088335 | A1 | 5/2020 | |

OTHER PUBLICATIONS

Non-final Office Action in corresponding U.S. Appl. No. 12/250,803 dated Jan. 5, 2024.

* cited by examiner

DEVICE FOR ADDING FLUID MEDIUM TO SHOWER SYSTEM, AND SHOWER SYSTEM

CROSS-REFERENCE TO RELATED APPLICATION(S)

This application is a continuation-in-part of U.S. patent application Ser. No. 17/250,803, a Section 371 National Stage Application of International Application No. PCT/CN2019/112922, filed Oct. 24, 2019 and published as WO 2020/088335 A1 on May 7, 2020, which further claims priority to Chinese Patent Application Ser. No. CN201821794448.5, filed on Nov. 1, 2018, the entire disclosure of each of which is incorporated herein by reference in entirety.

TECHNICAL FIELD

The present application relates to the technical field of shower system, and more particularly, to a device for adding a fluid medium to a shower system, and a shower system.

BACKGROUND

The existing shower system generally includes a water heater, a shower and a water mixing valve. An inlet of the water mixing valve is connected with an outlet of the water heater, the other inlet of the water mixing valve is connected with a cold water pipe, and an outlet of the water mixing valve is connected with the shower. Hot water in the water heater is mixed with cold water in the cold water pipe in the water mixing valve, and then is transported to the shower. Modern people habitually use water from the shower system for spraying or washing, and apply shower gel or soap on the skin during the shower to help personal hygiene. For a long time, people take shower gel through directly squeezing the bottle containing the shower gel by hand, and then apply it to the skin so that it can be mixed with water from the shower system or can be used for washing, which is tedious and troublesome.

SUMMARY

The present application aims to solve at least one of the technical problems existing in the prior art. To this end, the present application proposes a device for adding a fluid medium to a shower system. The device for adding the fluid medium to the shower system is simple in structure, and enables a user to control the supply of the fluid medium easily and conveniently while showering.

Embodiments of the present application provide a device for adding a fluid medium to a shower system. The device includes:

a water pipe assembly including a water pipe, in which the water pipe is provided with a water inlet and a water outlet, and the water inlet and the water outlet are configured to be connected with the shower system;

a reservoir for storing the fluid medium, in which the reservoir includes a first chamber and a second chamber which are separate from each other, the first chamber is configured to accommodate a first fluid medium, and the second chamber is configured to accommodate a second fluid medium different from the first fluid medium;

a fluid medium pipe assembly including a suction pipe and a switch valve, in which the suction pipe is provided with a fluid medium inlet and a fluid medium outlet, and the fluid medium outlet is connected with the water pipe assembly, in which the suction pipe includes a communication portion, a first suction portion and a second suction portion, in which a first end of the first suction portion extends into the first chamber, and a second end of the first suction portion is connected with a liquid inlet end of the communication portion, in which a first end of the second suction portion extends into the second chamber, and a second end of the second suction portion is connected with the liquid inlet end of the communication portion, in which the first end of the first suction portion and the second end of the second suction portion form the fluid medium inlet, and a liquid outlet end of the communication portion forms the fluid medium outlet, in which the switch valve is configured to allow the communication portion to be selectively in communication with the first suction portion or the second suction portion;

a valve body assembly including a first water pump and a three-way valve pipe, in which the water inlet is in communication with a water inlet pipe of the three-way valve pipe through the first water pump, a water return pipe of the three-way valve pipe is in communication with the fluid medium outlet, and a water mixing pipe of the three-way valve pipe is in communication with the water outlet, in which the water pipe assembly further includes a bypass pipe and a flow regulator, in which a water inlet end of the bypass pipe is in communication with the water inlet and the water inlet pipe, and a water outlet end of the bypass pipe is in communication with the water outlet and the water mixing pipe, in which the flow regulator is provided between the water inlet end of the bypass pipe and the water outlet end of the bypass pipe.

To this end, when the device for adding a fluid medium to a shower system according to the embodiments of the present application is used by a user, a negative pressure is generated in the water inlet pipe of the three-way valve pipe, thereby controlling the fluid medium to be sucked from the fluid medium inlet of the suction pipe and flow into the water return pipe of the three-way valve pipe. The fluid medium is mixed with the water flowing into the water inlet pipe of the three-way valve pipe in the water mixing pipe of the three-way valve pipe, and then flows into the shower system via the water outlet to supply the fluid medium for the user. In the above operations, the fluid medium can be brought into contact with the skin of the user without directly squeezing the bottle containing the fluid medium by hand.

The additional aspects and advantages of the present application will be partly given in the following description, and some of the additional aspects and advantages will become obvious from the following description, or be understood through the practice of the present application.

BRIEF DESCRIPTION OF THE DRAWINGS

In order to illustrate technical solutions provided in embodiments of the present application or in the prior art more clearly, the disclosure will be further elaborated with the drawings for illustrating the embodiments or the prior art. It is apparent that the drawings in the following descriptions only show some embodiments of the present application. Other drawings may further be obtained by those of ordinary skill in the art according to these drawings without creative work.

Figure 1:
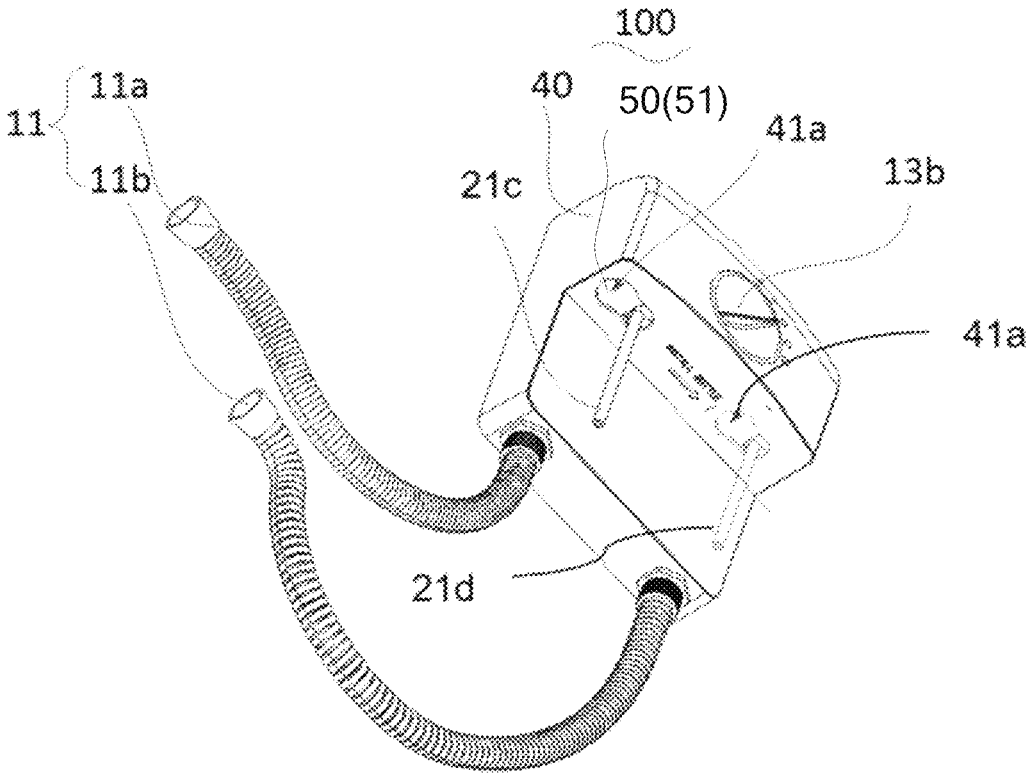
FIG. 1 is a perspective view of a device for adding a fluid medium to a shower system according to an embodiment of the present application.

LIST OF REFERENCE SYMBOLS device 100 for adding a fluid medium to a shower system, water pipe assembly 10, water pipe 11, water inlet 11*a*, water outlet 11*b*, bypass pipe 12, water inlet end 12*a*, water outlet end 12*b*, flow regulator 13, second activation element 13*a*, second rotary knob 13*b*, first one-way valve 14, fluid medium pipe assembly 20, suction pipe 21, fluid medium inlet 21*a*, fluid medium outlet 21*b*, first suction portion 21*c*, second suction portion 21*d*, communication portion 21*e*, venturi switch 22, first activation element 22*a*, first rotary knob 22*b*, switch valve 23, valve body assembly 30, three-way valve pipe 31, water inlet pipe 31*a*, water return pipe 31*b*, water mixing pipe 31*c*, second one-way valve 32, first water pump 33, box body 40, through hole 41*a* first reservoir 50, first protrusion 51, second reservoir 52, first chamber 52*a*, second chamber 52*b*, second protrusion 52 fixing plate 60, first groove portion 61, bottom plate 70, second groove portion 71, third groove portion 72, control system 80, controller 81, battery 82, radio frequency receiver 83, reversing valve assembly 90, first valve port 91, second valve port 92, third valve port 93, fourth valve port 94, second water pump 95, first on-off valve 96, second on-off valve 97.

The implementations of the purposes, functional characteristics, and advantages of the present application will be further described in conjunction with the embodiments and with reference to the drawings.

DETAILED DESCRIPTION OF ILLUSTRATIVE EMBODIMENTS

The embodiments of the present application will be described in detail below. Examples of the embodiments are shown in the drawings in which the same or similar reference symbols represent the same or similar elements or elements with the same or similar functions. It is to be understood that the embodiments described below with reference to the drawings are exemplary, and are merely intended to illustrate the present application, but are not be intended to limit the present application.

The following description provides many different embodiments or examples for implementing different structures of the present application. In order to simplify the disclosure of the present application, the components and arrangements of the specific examples are described below. Of course, they are only exemplary and are not intended to limit the present application. In addition, reference symbols and/or letters may be repeated in the various examples of the present application. This repetition is for the purpose of simplicity and clarity and does not indicate a relationship between the various embodiments and/or arrangements discussed. Furthermore, various specific processes and materials are provided in the present application, but it is known for those of ordinary skill in the art that other processes and/or other materials may be used.

Figure 2:
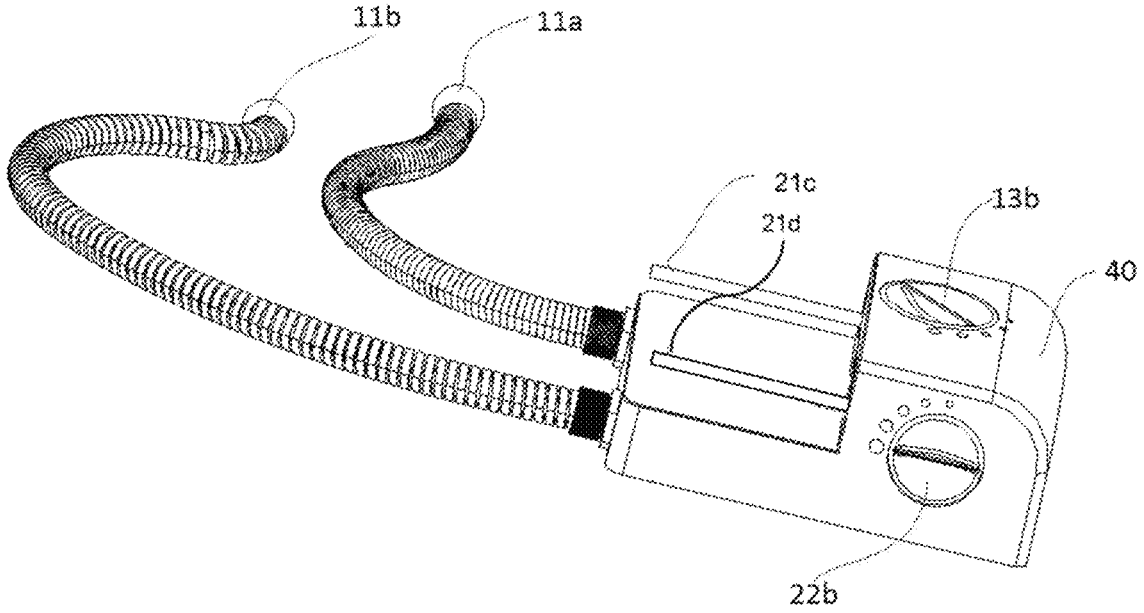
FIG. 2 is a perspective view of the embodiment shown in FIG. 1 from another perspective.
Figure 3:
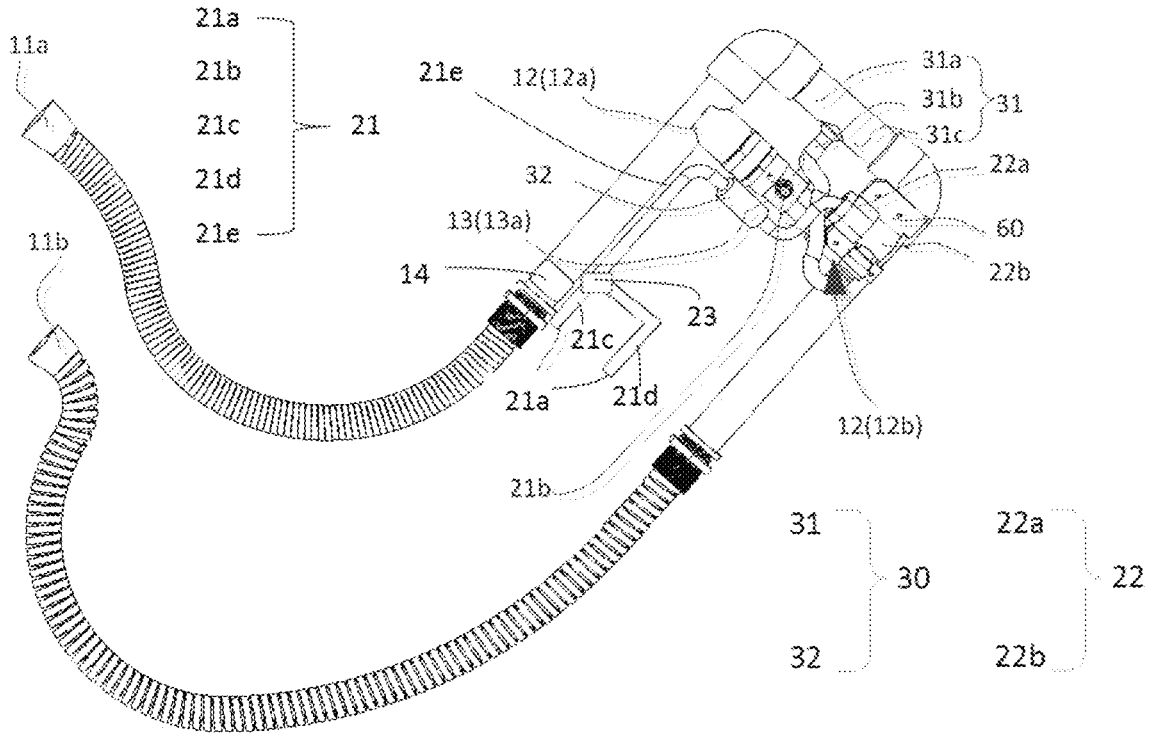
FIG. 3 is a perspective view illustrating the connection of a pipe assembly and a valve body assembly of the embodiment shown in FIG. 1.
Figure 4:
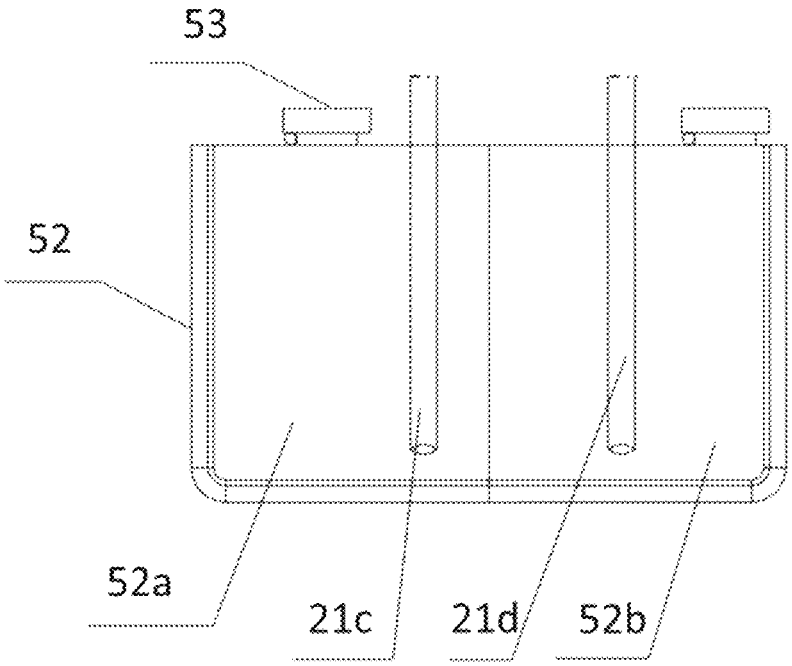
FIG. 4 is a front view of a reservoir according to an embodiment of the present application.
Figure 5:
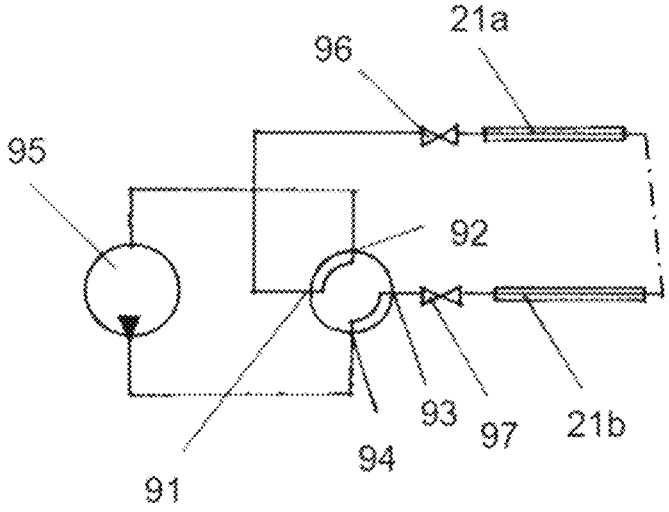
FIG. 5 is a schematic diagram of a reversing valve assembly shown in FIG. 1.
Figure 6:
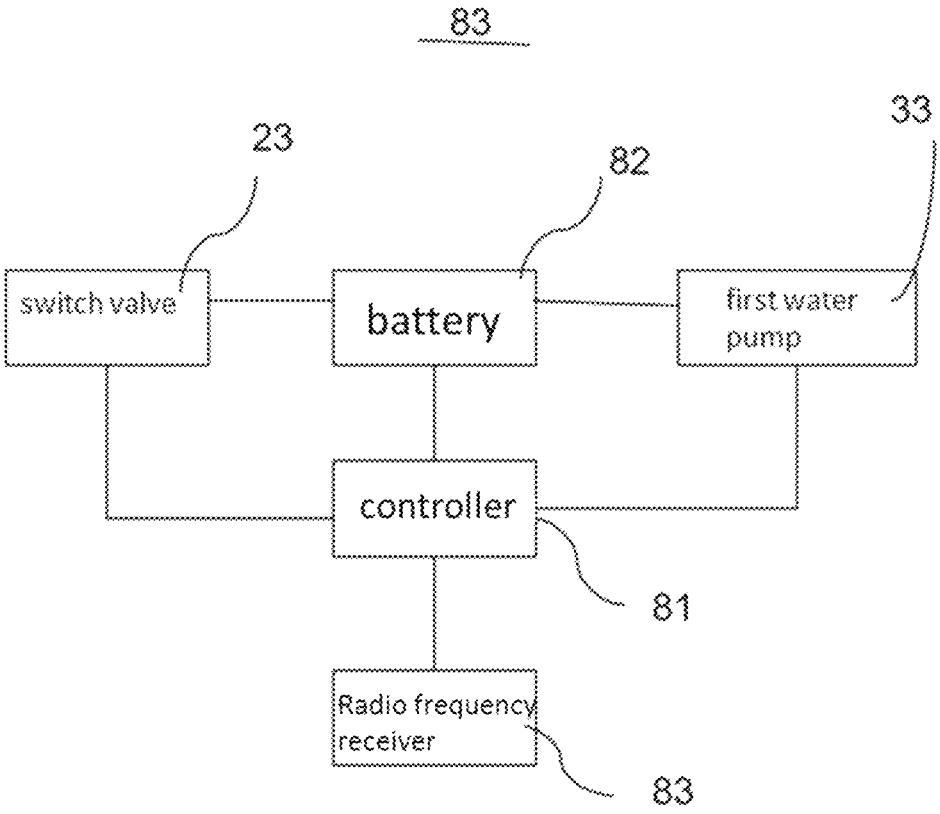
FIG. 6 is a schematic diagram of a control system shown in FIG. 1.
Figure 7:
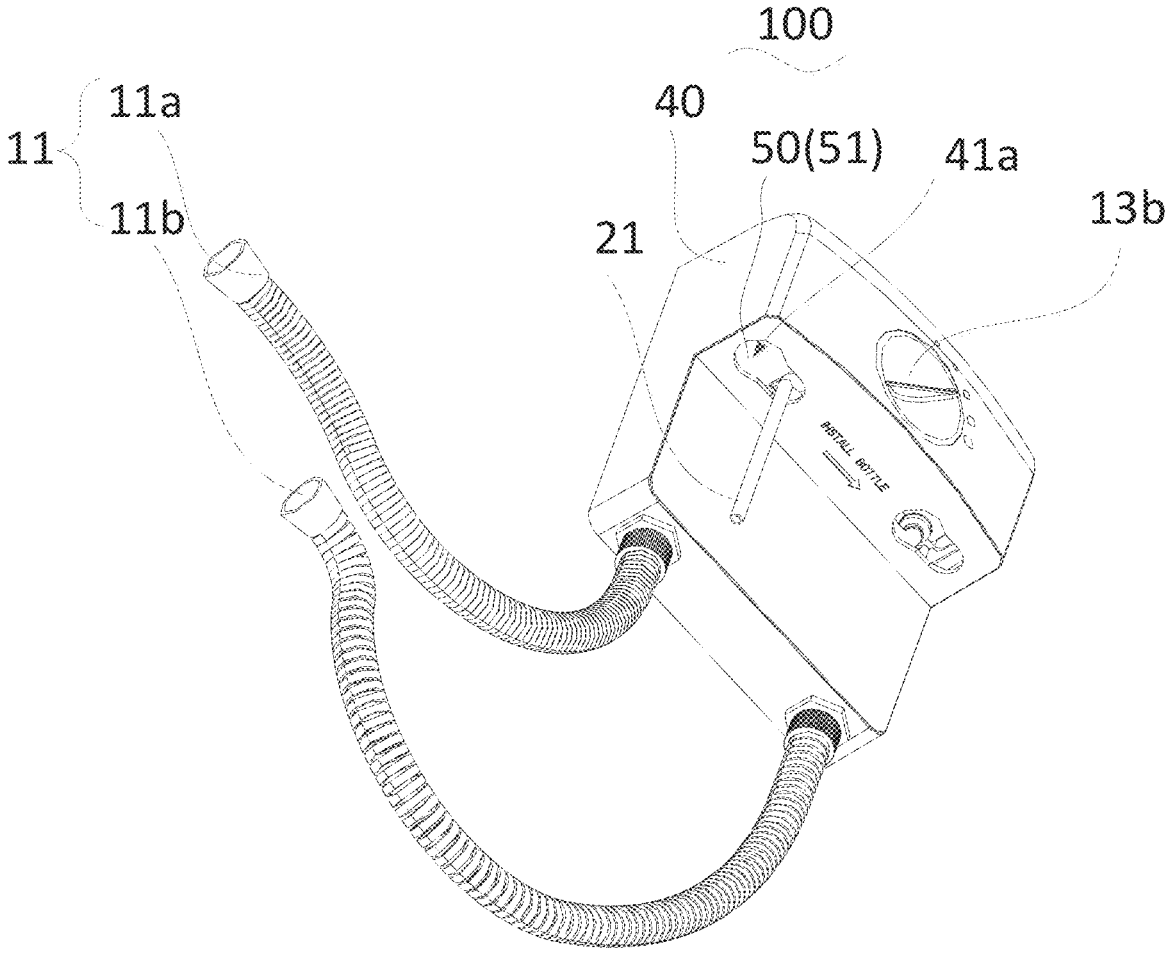
FIG. 7 is a perspective view of a device for adding a fluid medium to a shower system according to another embodiment of the present application.
Figure 8:
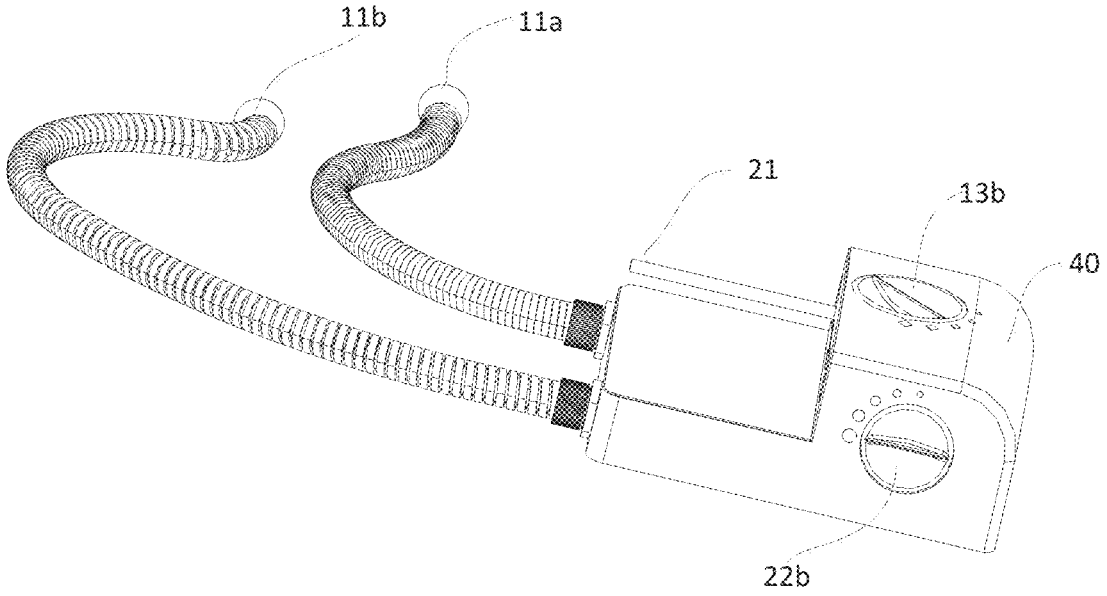
FIG. 8 is a perspective view of the embodiment shown in FIG. 7 from another perspective.
Figure 9:
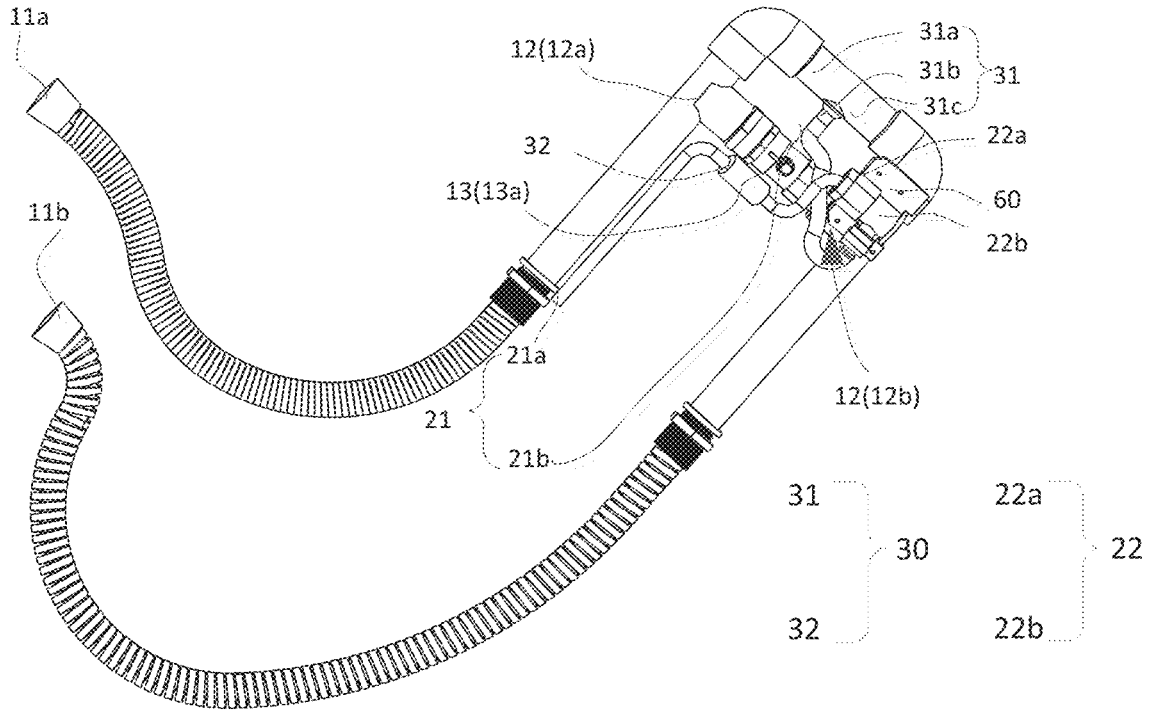
FIG. 9 is a perspective view illustrating the connection of a pipe assembly and a valve body assembly of the embodiment shown in FIG. 7.
Figure 10:
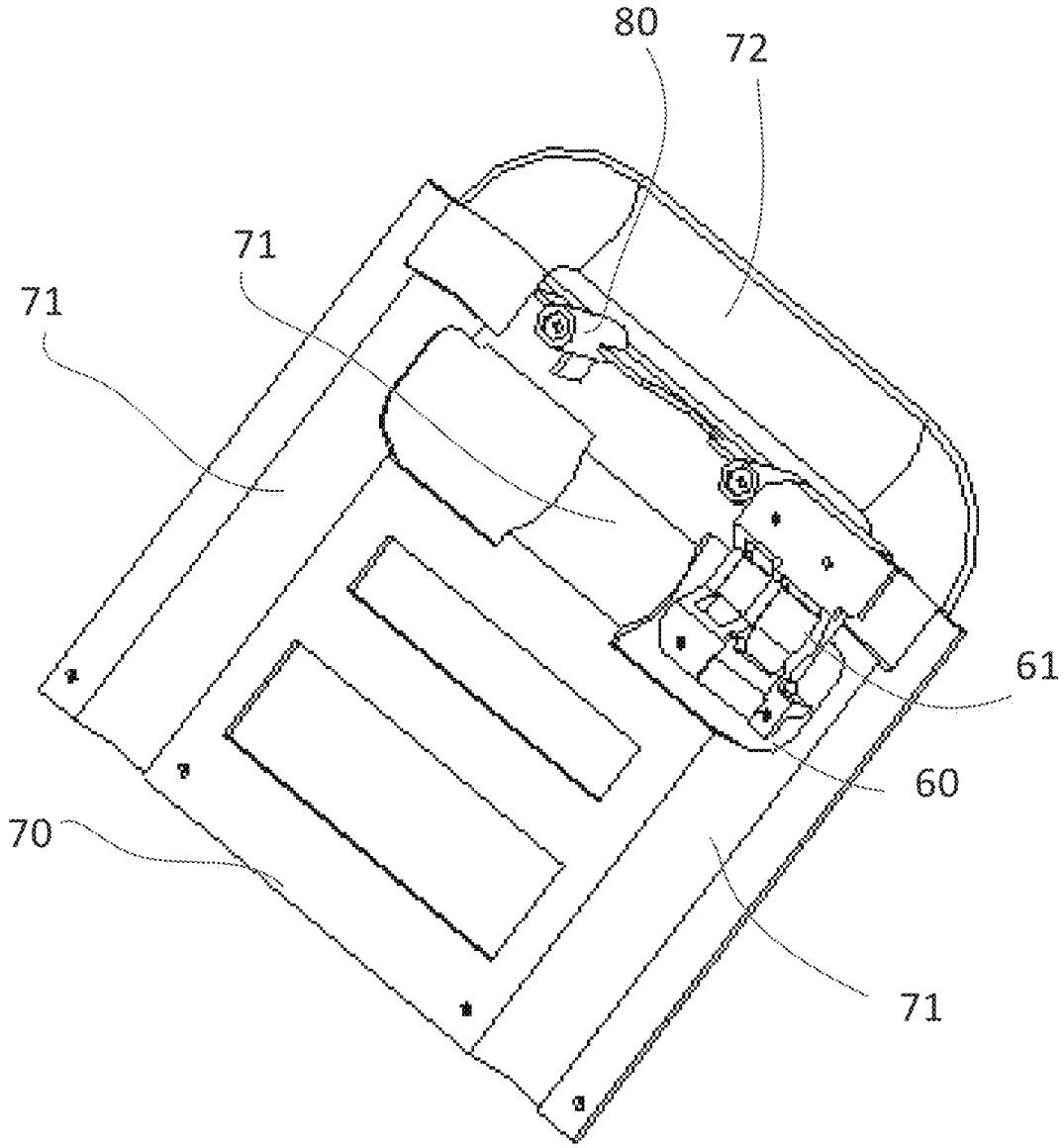
FIG. 10 is a front view of a bottom plate and a fixing plate of the embodiment shown in FIG. 7.
Figure 11:
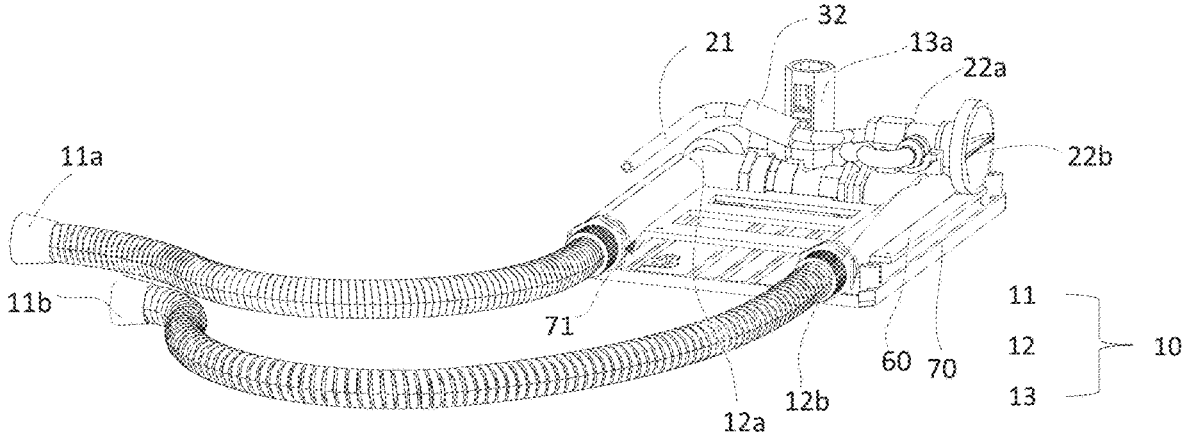
FIG. 11 is a perspective view illustrating the assembly of a bottom plate, a pipe assembly and a valve body assembly of the embodiment shown in FIG. 7.

A device 100 for adding a fluid medium to a shower system according to an embodiment of the present application will be described below with reference to FIGS. 1-11.

The device 100 for adding a fluid medium to a shower system according to the embodiment of the present application includes a water pipe assembly 10, a first reservoir 50 for storing the fluid medium, a fluid medium pipe assembly 20, and a valve body assembly 30. The water pipe assembly 10 includes a water pipe 11 provided with a water inlet 11*a* and a water outlet 11*b*, and the water inlet 11*a* and the water outlet 11*b* are configured to be connected with the shower system. The second reservoir 52 includes a first chamber 52*a* and a second chamber 52*b* which are separate from each other, the first chamber 52*a* is configured to accommodate a first fluid medium, and the second chamber 52*b* is configured to accommodate a second fluid medium different from the first fluid medium. The fluid medium pipe assembly 20 includes a suction pipe 21 and a switch valve 23, the suction pipe 21 is provided with a fluid medium inlet 21*a* and a fluid medium outlet 21*b*, and the fluid medium outlet 21*b* is connected with the water pipe assembly 10. The suction pipe 21 includes a communication portion 21*e*, a first suction portion 21*c*, and a second suction portion 21*d*. A first end of the first suction portion 21*c* extends into the first chamber 52*a*, and a second end of the first suction portion 21*c* is connected with a liquid inlet end of the communication portion 21*c*. A first end of the second suction portion 21*d* extends into the second chamber 52*b*, and a second end of the second suction portion 21*d* is connected with the liquid inlet end of the communication portion 21*e*. The first end of the first suction portion 21*c* and the second end of the second suction portion 21*d* form the fluid medium inlet 21*a*, and a liquid outlet end of the communication portion forms the fluid medium outlet 21*b*. The switch valve 23 is configured to allow the communication portion 21*e* to be selectively in communication with the first suction portion 21*c* or the second suction portion 21*d*. The valve body assembly 30 includes a first water pump 33 and a three-way valve pipe 31. The water inlet 11*a* is in communication with a water inlet pipe 31*a* of the three-way valve pipe 31 through the first water pump 33, a water return pipe 31*b* of the three-way valve pipe 31 is in communication with the fluid medium outlet 21*b*, and a water mixing pipe 31*c* of the three-way valve pipe 31 is in communication with the water outlet 11*b*. The water pipe assembly further includes a bypass pipe 12 and a flow regulator 13. A water inlet end 12*a* of the bypass pipe 12 is in communication with the water inlet 11*a* and the water inlet pipe 31*a*, and a water outlet end 12*b* of the bypass pipe 12 is in communication with the water outlet 11*b* and the water mixing pipe 31*c*. The flow regulator 13 is provided between the water inlet end 12*a* of the bypass pipe 12 and the water outlet end 12*b* of the bypass pipe 12.

Thereby, when the device 100 for adding a fluid medium to a shower system according to the embodiment of the present application is used by a user, a negative pressure is generated in the water inlet pipe 31*a* of the three-way valve pipe 31 of the device of the present application, so as to control a fluid medium to be sucked from a fluid medium inlet 21*a* of the suction pipe 21 and flow into a water return pipe 31*b* of the three-way valve pipe 31. The fluid medium is mixed with the water flowing into the water inlet pipe 31*a* of the three-way valve pipe 31 in the water mixing pipe 31*c* of the three-way valve pipe 31, and then flows into the shower system via the water outlet 11*b* to supply the fluid medium for the user. The design of the bypass pipe 12 can enhance the injection effect of the three-way valve pipe 31. The flow regulator 13 is provided between the water inlet end 12*a* of the bypass pipe 12 and the water outlet end 12*b* of the bypass pipe 12. The design of the flow regulator 13 can control the strength of the injection effect of the three-way valve pipe 31. The first water pump 33 can provide power for water. The first chamber 52*a* and the second chamber 52*b* accommodate different fluid mediums. The user can control whether the first fluid medium accommodated in the first chamber 52*a* flows into the suction pipe 21 or the second fluid medium accommodated in the second chamber 52*b* flows into the suction pipe 21 by controlling the switch valve 23, to supply the user. The device 100 of the embodiments of the present application can stably and reliably provide the fluid medium to the user.

In some specific examples of the present application, the water pipe assembly 10 includes a first one-way valve 14 for preventing a back flow of the water, and the first one-way valve 14 is provided between the water inlet 11*a* and the water inlet end 12*a* of the bypass pipe 12. The device 100 of the embodiment of the present application can prevent water from flowing back.

In some specific examples of the present application, a front face or a side face of the second reservoir 52 is provided with an opening configured to allow a gel or tablet to be dispensed into the first chamber 52*a* and/or the second chamber 52*b*. The second reservoir 52 further includes a door configured to open or close the second reservoir 52. The door allows the corresponding first chamber 52*a* or second chamber 52*b* to form a sealed environment when closing the opening of the second reservoir 52. When the user uses the device 100 of the present embodiment, a bath gel, a shampoo gel, a bath tablet (such as a bath effervescent tablet), or a shampoo tablet (such as a shampoo effervescent tablet) can be dispensed through the opening of the second reservoir 52, and the opening of the second reservoir 52 can be closed by the door. It will be appreciated that when the user dispenses a bath tablet (such as a bath effervescent tablet) or a shampoo tablet (such as a shampoo effervescent tablet) through the opening of the second reservoir 52, the user may also pour water inward through the opening of the second reservoir 52 to allow the tablet to be decomposed in the water to form a fluid medium.

In some specific examples of the present application, the device 100 further includes a reversing valve assembly 90 configured to control a flow direction. The reversing valve assembly 90 is disposed between the fluid medium inlet 21*a* and the fluid medium outlet 21*b*. The reversing valve assembly 90 is configured to control water to flow from the fluid medium outlet 21*b* to the fluid medium inlet, and the reversing valve assembly 90 is further configured to control the fluid medium to flow from the fluid medium inlet to the fluid medium outlet 21*b*. It will be appreciated that when the user dispenses a bath tablet (such as a bath effervescent tablet) or a shampoo tablet (such as a shampoo effervescent tablet) through the opening of the second reservoir 52, the reversing valve assembly 90 may control the water to flow from the fluid medium outlet 21*b* to the fluid medium inlet, to allow the tablet in the f second reservoir 52 to be decomposed in the water to form the fluid medium.

In some specific examples of the present application, the bottom of the box body 40 is provided with a through hole 41*a*, and the second reservoir 52 is provided with a second protrusion 53 that is plug-fitted with the through hole 41*a*. The installation and removal of the box body 40 and the second reservoir 52 may be achieved by pulling and pushing.

In some specific examples of the present application, the reversing valve assembly 90 includes a first valve port 91, a second valve port 92, a third valve port 93, a fourth valve port 94, a second water pump 95, a first on-off valve 96, and a second on-off valve 97. The first valve port 91 is connected with an inlet of the second water pump 95, the third valve port 93 is connected with an outlet of the second water pump 95, the second valve port 92 is connected with the first on-off valve 96, the fourth valve port 94 is connected with the second on-off valve 97, the first on-off valve 96 is connected with the fluid medium inlet 21*a*, and the second on-off valve 97 is connected with the fluid medium outlet 21*b*. When the user dispenses a tablet into the first chamber 52*a*, the reversing valve assembly 90 is configured to allow the third valve port 93 to be in communication with the second valve port 92 and to allow the first valve port 91 to be in communication with the fourth valve port 94, and the second water pump 95 is configured to allow water to flow from the fluid medium outlet 21*b* to the fluid medium inlet to flow into the second reservoir 52; the reversing valve assembly 90 is configured to allow the third valve port 93 to be in communication with the first valve port 91 and allow the second valve port 92 to be in communication with the fourth valve port 94, and the second water pump 95 is configured to allow the fluid medium water in the second reservoir 52 to flow from the fluid medium inlet to the fluid medium outlet 21*b*.

In some specific examples of the present application, the device 100 further includes a control system 80 including a controller 81 and a battery 82. An output end of the battery 82 is connected with a power supply end of the controller 81, a power supply end of the switch valve 23, and a power supply end of the first water pump 33. An output end of the controller 81 is connected with an input end of the first water pump 33 and an input end of the switch valve 23. When the user uses the device 100 of the present embodiment, the controller 81 can control the operation of the first water pump 33 to control the flow rate of water or the working state of the device 100. The user can also control the operation of the switch valve 23 through the controller 81 to control whether the first fluid medium accommodated in the first chamber 52*a* flows into the suction pipe 21 or the second fluid medium accommodated in the second chamber 52*b* flows into the suction pipe 21, to supply the user.

In some specific examples of the present invention, the control system 80 further includes a radio frequency receiver 83. The output end of the battery 82 is connected with a power supply end of the radio frequency receiver 83, and the switch valve 23 is connected with the radio frequency receiver 83 through the controller 81. The radio frequency receiver 83 is configured to acquire a first command for controlling the communication portion 21*e* to be in communication with the first suction portion 21*c* or the second suction portion 21*d*, and the controller 81 controls the operation of the switch valve 23 according to the first command. In some specific examples of the present application, the control system 80 further includes a radio frequency receiver 83. The output end of the battery 82 is connected with a power supply end of the radio frequency receiver 83, and the first water pump 33 is connected with the radio frequency receiver 83 through the controller 81. The radio frequency receiver 83 is configured to acquire a second command for controlling the first water pump 33, and the controller 81 controls the operation of the first water pump 33 according to the second command. The user may transmit the first command or the second command of a mobile app or a remote controller to the controller 81 through the radio frequency receiver 83. This design improves the user experience.

In some specific examples of the present application, an outer surface of at least one of the water pipe 11, the suction pipe 21, the valve body assembly 30 or the bypass pipe 12 is at least partially covered with an antimicrobial material.

The device 100 for adding a fluid medium to a shower system according to the embodiment of the present application includes a water pipe assembly 10, a fluid medium pipe assembly 20, and a valve body assembly 30. The water pipe assembly 10 includes a water pipe 11 provided with a water inlet 11*a* and a water outlet 11*b*, and the water inlet 11*a* and the water outlet 11*b* are configured to be connected with the shower system. The fluid medium pipe assembly 20 includes a suction pipe 21, the suction pipe 21 is provided with a fluid medium inlet 21*a* and a fluid medium outlet 21*b*, and the fluid medium outlet 21*b* is connected with the water pipe assembly 10. The valve body assembly 30 includes a second one-way valve 32 for preventing a back flow of the fluid medium and a three-way valve pipe 31. The second one-way valve 32 is provided between the fluid medium inlet 21*a* and the fluid medium outlet 21*b*. The three-way valve pipe 31 includes a three-way valve pipe. A water inlet pipe 31*a* of the three-way valve pipe is in communication with the water inlet 11*a*, a water return pipe 31*b* of the three-way valve pipe is in communication with the fluid medium outlet 21*b*, and a water mixing pipe 31*c* of the three-way valve pipe is in communication with the water outlet 11*b*.

Thereby, when the device 100 for adding a fluid medium to a shower system according to the embodiment of the present application is used by a user, a negative pressure is generated in the water inlet pipe 31*a* of the three-way valve pipe 31 of the device of the present application, so as to control a fluid medium to be sucked from the fluid medium inlet 21*a* of the suction pipe 21 and flow into the water return pipe 31*b* of the three-way valve pipe 31. The fluid medium is mixed with the water flowing into the water inlet pipe 31*a* of the three-way valve pipe 31 in the water mixing pipe 31*c* of the three-way valve pipe 31, and then flows into the shower system via the water outlet 11*b* to supply the fluid medium for the user. In the above operations, the fluid medium can be brought into contact the skin of the user without directly squeezing the bottle containing the fluid medium by hand.

In addition, the device 100 for adding a fluid medium to a shower system according to the embodiment of the present application can achieve at least some of the following effects.

Reliability is good. The device according to the embodiment of the present application is provided with a second one-way valve 32 between the fluid medium inlet 21*a* and the fluid medium outlet 21*b*. Therefore, such device of the present application can prevent the fluid medium from flowing back and prevent water from flowing out of the fluid medium inlet 21*a* and in turn contaminating the fluid medium.

The versatility is good. The device according to the embodiment of the present application can be directly installed in the existing shower system, which can easily and quickly solve the cumbersome cleaning work of the user.

It is understood for those skilled in the art that the fluid medium used by people when showering includes perfume, soapy water, shampoo, shower gel or other skin care products in form of fluid.

The device according to the embodiment of the present application can be used in any shower system, such as a shower system with a shower room, a shower at a floor level, a large-capacity shower, or the like. The device according to the embodiment of the present application can also be integrated into a bathtub.

In some specific examples of the present application, the three-way valve pipe includes a venturi nozzle. The water inlet pipe 31*a*, the water return pipe 31*b* and the water mixing pipe 31*c* meet at a center (not shown), and the venturi nozzle is provided between the water inlet pipe 31*a* and the center. The venturi nozzle has a continuously reduced cross-sectional area of a flow channel, which can form a low pressure in the water inlet pipe 31*a*, thereby sucking the fluid medium transported and mixing it with water in the water mixing pipe 31*c*. The device according to the embodiments of the present application has a strong self-suction capability and can reliably suck the fluid medium into the water pipe 11.

In some specific examples of the present application, the three-way valve pipe is a venturi three-way valve pipe. The venturi three-way valve pipe has a venturi nozzle that continuously reduces a cross-sectional area of a flow channel and a venturi diffusion chamber that continuously increases the cross-sectional area of the flow channel (the venturi diffusion chamber is located between the center and the water outlet 11*b*). Therefore, the device according to the embodiments of the present application has a better self-suction capability. In addition, the venturi diffusion chamber is relatively insensitive to the impurities, and thus is especially suitable as a discharge pipe for the mixed liquid after the fluid medium is mixed with water.

In some specific examples of the present application, the fluid medium pipe assembly 20 includes a venturi switch 22, and the venturi switch 22 is provided between the fluid medium inlet 21*a* and the water return pipe 31*b*. The venturi switch 22 may be used to control the opening and closing of the valve body assembly 30, thereby meeting the needs of a user to start or stop using the mixed liquid after the fluid medium is mixed with water.

In some specific examples of the present application, the device includes a box body 40. The fluid medium pipe assembly 20 and the valve body assembly 30 are disposed in the box body 40. The box body 40 is designed to protect the fluid medium pipe assembly and the valve body assembly 30 from being damaged by external forces and also for aesthetics.

In some specific examples of the present application, the device includes the box body 40 and a fixing plate 60. The fixing plate 60 has a first groove portion 61. The venturi switch 22 includes a first activation element 22*a*, and the first activation element 22*a* is disposed in the first groove portion 61 and faces a left side face or a right side face of the box body 40. When the device according to the embodiments of the present application is hung on a wall with a height of about 1.5 meters from the ground, the activation element of the venturi switch 22 is arranged on the side face of the box body 40, conforming to human mechanics.

Those skilled in the art can understand that when the device according to the embodiments of the present application is hung on a wall with a height of about 0.5 meters from the ground, the activation element of the venturi switch 22 is arranged on the top face of the box body 40, conforming to human mechanics In some specific examples of the present application, the venturi switch 22 further includes a first switching element (not shown) and a first rotary knob 22*b*. The first rotary knob 22*b* is connected with the first activation element 22*a*, and the first rotary knob 22*b* protrudes from the box body 40 to facilitate the user operation.

In some specific examples of the present application, the water pipe assembly 10 includes a bypass pipe 12. A water inlet end 12*a* of the bypass pipe 12 is in communication with the water inlet 11*a* and the water inlet pipe 31*a* respectively, and a water outlet end 12*b* of the bypass pipe 12 is in communication with the water outlet 11*b* and the water mixing pipe 31*c* respectively. The design of the bypass pipe 12 can enhance the injection effect of the three-way valve pipe 31. The device of the embodiments of the present application can stably and reliably provide the fluid medium to the user.

Before the inventors designed a water pipe assembly 10 provided by the embodiments of the present application to include a bypass pipe 12, the device provided the embodiments of the present application is difficult to reliably supply the fluid medium to the user when the three-way valve pipe 31 is damaged or the user's home water pressure is insufficient. In order to solve the above-mentioned problem, the inventors herein have designed a device 100 for adding a fluid medium to a shower system including a bypass pipe 12 in an embodiment of the present application.

In some specific examples of the present application, the water pipe assembly 10 includes a flow regulator 13, and the flow regulator 13 is provided between the water inlet end 12*a* of the bypass pipe 12 and the water outlet end 12*b* of the bypass pipe 12. The flow regulator 13 is designed to control the strength of the injection effect of the three-way valve pipe 31, so that the device of the embodiment of the present application can stably and reliably supply the fluid medium for the user.

In some specific examples of the present application, the flow regulator 13 further includes a second activation element 13*a*, a second switching element (not shown), and a second rotary knob 13*b*. The second activation element 13*a* is connected with the second rotary knob 13*b*, and the second rotary knob 13*b* protrudes from the box body 40 to facilitate the user operation.

In some specific examples of the present application, the second rotary knob 13*b* is provided on the front of the box body 40, conforming to human mechanics.

In some specific examples of the present application, the bottom of the box body 40 is provided with a first reservoir 50 for storing the fluid medium. The suction pipe 21 is extends into the first reservoir 50. When the user uses the device according to the embodiment of the present application, the negative pressure is generated in the water inlet pipe 31*a* of the three-way valve pipe 31, thereby sucking the fluid medium in the first reservoir 50 via the fluid medium inlet 21*a* of the suction pipe 21.

In some specific examples of the present application, the box body 40 is detachably connected with the first reservoir 50. This design is convenient for the user to place the fluid medium in the first reservoir 50.

In some specific examples of the present application, the bottom of the box body 40 is provided with a through hole 41*a*, and the first reservoir 50 is provided with a first protrusion 51 that is plug-fitted with the through hole 41*a*. The installation and removal of the box body 40 and the first reservoir 50 may be achieved by pulling and pushing.

In some specific examples of the present application, the suction pipe 21 is a flexible pipe. This design facilitates the installation and removal of the box body 40 and the first reservoir 50. The first reservoir 50 and the second reservoir 52 may be the same component or different components.

In some specific examples of the present application, the device includes a bottom plate 70. The bottom plate 70 is provided with a second groove portion 71 and a third groove portion 72, the water pipe 11 is disposed in the second groove portion 71, and the three-way valve pipe 31 is disposed in the third groove portion 72. The design of the second groove portion 71 and the third groove portion 72 on the bottom plate 70 facilitates the installation and fixing of the water pipe 11 and the three-way valve pipe 31, and the device according to the embodiments of the present application will not scatter during the transportation and use.

In some specific examples of the present application, the box body 40 includes a box cover and a box bottom. The box cover and the box bottom are connected by a screw and/or a buckle. The bottom face of the box bottom has a through hole for hanging on the wall. The bottom plate 70 is fixedly connected with the box bottom. The fixing plate 60 is provided on the bottom plate 70.

In some specific examples of the present application, the device includes a connecting plate 80 fixedly connected with the bottom plate 70. The connecting plate 80 is provided with a screw hole for connection with a screw of the box cover.

In some specific examples of the present application, the fluid medium includes one or more fragrance medium. Those skilled in the art can understand that the fluid medium used by people when showering includes perfume, soapy water, shampoo, shower gel or other skin care products in form of fluid.

A shower system according to an embodiment of the present application, includes a showerhead (not shown) and a water source connector for introducing water. A water inter (not shown) of the showerhead is in communication with a water outlet (not shown) of the water source connector. The shower system further includes the device 100 for adding a fluid medium to the shower system as described above. The water outlet of the water source connector is further in communication with the water inlet 11*a*, and the water inter of the showerhead is further in communication with the water outlet 11*b*.

The shower system according to the embodiment of the present application enables the user to control the supply of the fluid medium easily while showering. In addition, the shower system according to the embodiment of the present application has other advantages as described for the above device 100 for adding a fluid medium to a shower system, which will not be repeated here.

In some specific examples of the present application, the system further includes a four-way valve pipe (not shown) provided with a first water inlet, a first water outlet, a second water inlet and a second water outlet. The first water inlet is in communication with the water outlet of the water source connector, the first water outlet is in communication with the water inlet 11*a*, the second water inlet is in communication with the water outlet 11*b*, and the second water outlet is in communication with the water inlet of the showerhead. When the user does not need the fluid medium, water reaches the user in two branches in which the first branch of water flows through the first water inlet and the second water outlet, and the second branch of water flows through the first water inlet, the first water outlet, the second water inlet and the second water outlet. As such, the supply of the fluid medium is stopped through controlling the venturi switch 22 by the user. When the user needs the fluid medium, water reaches the user through the first water inlet and the second water outlet, and the mixture of the liquid medium and water reaches the user through the second water inlet and the second water outlet.

In the description of the present application, it is should be understood that terms "first", "second", and "third" are only used for the purpose of description, but are not intended to indicate or imply the relative importance or implicitly indicate the number of technical features indicated. Therefore, a feature defined by "first", "second" and "third" may explicitly or implicitly includes one or more such features. In the description of the present application, the term "a plurality of" indicates two and more, unless expressly specified otherwise.

In the description of the present application, reference to "an embodiment", "some embodiments", "an example", "specific examples" or "some examples" herein means that the specific feature, structure, or characteristic described in conjunction with the embodiments or examples may be included in at least one embodiment or example of the present application. In this description, the schematic representations of the above terms do not necessarily refer to the same embodiment or example. Moreover, the described specific features, structures, materials or characteristics can be combined in any one or more embodiments or examples in a suitable manner. In addition, those skilled in the art may combine the different embodiments or examples and the features of the different embodiments or examples described in this specification when they are not mutually contradict.

Although the embodiments of the present application have been shown and described, those of ordinary skill in the art may understand that various changes, modifications, substitutions and variations may be made to these embodiments without departing from the principle and spirit of the present application. The scope of the present application is defined by the claims and their equivalents.

The invention claimed is:

1. A device for adding a fluid medium to a shower system, comprising:

a water pipe assembly comprising a water pipe, wherein the water pipe is provided with a water inlet and a water outlet, and the water inlet and the water outlet are configured to be connected with the shower system;

a reservoir for storing the fluid medium, wherein the reservoir comprising a first chamber and a second chamber which are separate from each other, the first chamber is configured to accommodate a first fluid medium, and the second chamber is configured to accommodate a second fluid medium different from the first fluid medium;

a fluid medium pipe assembly comprising a suction pipe and a switch valve, wherein the suction pipe is provided with a fluid medium inlet and a fluid medium outlet, and the fluid medium outlet is connected with the water pipe assembly, wherein the suction pipe comprises a communication portion, a first suction portion and a second suction portion, wherein a first end of the first suction portion extends into the first chamber, and a second end of the first suction portion is connected with a liquid inlet end of the communication portion, wherein a first end of the second suction portion extends into the second chamber, and a second end of the second suction portion is connected with the liquid inlet end of the communication portion, wherein the first end of the first suction portion and the second end of the second suction portion form the fluid medium inlet, and a liquid outlet end of the communication portion forms the fluid medium outlet, wherein the switch valve is configured to allow the communication portion to be selectively in communication with the first suction portion or the second suction portion;

a valve body assembly comprising a first water pump and a three-way valve pipe, wherein the water inlet is in communication with a water inlet pipe of the three-way valve pipe through the first water pump, a water return pipe of the three-way valve pipe is in communication with the fluid medium outlet, and a water mixing pipe of the three-way valve pipe is in communication with the water outlet, wherein the water pipe assembly further comprises a bypass pipe and a flow regulator, wherein a water inlet end of the bypass pipe is in communication with the water inlet and the water inlet pipe, and a water outlet end of the bypass pipe is in communication with the water outlet and the water mixing pipe, wherein the flow regulator is provided between the water inlet end of the bypass pipe and the water outlet end of the bypass pipe.

2. The device for adding a fluid medium to a shower system according to claim 1, wherein the water pipe assembly comprises a first one-way valve for preventing a back flow of water, and the first one-way valve is provided between the water inlet and the water inlet end of the bypass pipe.

3. The device for adding a fluid medium to a shower system according to claim 1, wherein a front face or a side face of the reservoir is provided with an opening configured to allow a gel or tablet to be dispensed into at least one of the first chamber or the second chamber, the reservoir further comprises a door configured to open or close the reservoir, wherein the door allows corresponding first chamber or second chamber to form a sealed environment when closing the opening of the reservoir.

4. The device for adding a fluid medium to a shower system according to claim 3, wherein the device further comprises a reversing valve assembly configured to control a flow direction, the reversing valve assembly is disposed between the fluid medium inlet and the fluid medium outlet, wherein the reversing valve assembly is configured to control water to flow from the fluid medium outlet to the fluid medium inlet, and the reversing valve assembly is further configured to control the fluid medium to flow from the fluid medium inlet to the fluid medium outlet.

5. The device for adding a fluid medium to a shower system according to claim 4, wherein the reversing valve assembly comprises a first valve port, a second valve port, a third valve port, a fourth valve port, a second water pump, a first on-off valve, and a second on-off valve, wherein the first valve port is connected with an inlet of the second water pump, the third valve port is connected with an outlet of the second water pump, the second valve port is connected with the first on-off valve, the fourth valve port is connected with the second on-off valve, the first on-off valve is connected with the fluid medium inlet, and the second on-off valve is connected with the fluid medium outlet, wherein when a user dispenses a tablet into the first chamber, the reversing valve assembly is configured to allow the third valve port to be in communication with the second valve port and to allow the first valve port to be in communication with the fourth valve port, and the second water pump is configured to allow water to flow from the fluid medium outlet to the fluid medium inlet to flow into the reservoir; the reversing valve assembly is configured to allow the third valve port to be in communication with the first valve port and allow the second valve port to be in communication with the fourth valve port, and the second water pump is configured to allow fluid medium water in the reservoir to flow from the fluid medium inlet to the fluid medium outlet.

6. The device for adding a fluid medium to a shower system according to claim 1, wherein the device further comprises a control system comprising a controller and a battery, wherein an output end of the battery is connected with a power supply end of the controller, a power supply end of the switch valve, and a power supply end of the first water pump, wherein an output end of the controller is connected with an input end of the first water pump and an input end of the switch valve.

7. The device for adding a fluid medium to a shower system according to claim 6, wherein the control system further comprises a communication module, the output end of the battery is connected with a power supply end of the communication module, and the switch valve is connected with the radio frequency receiver through the controller, wherein the radio frequency receiver is configured to acquire a first command for controlling the communication portion to be in communication with the first suction portion or the second suction portion, and the controller controls an operation of the switch valve according to the first command.

8. The device for adding a fluid medium to a shower system according to claim 6, wherein the control system further comprises a communication module, the output end of the battery is connected with a power supply end of the communication module, and the first water pump is connected with the radio frequency receiver through the controller 81, wherein the radio frequency receiver is configured to acquire a second command for controlling the first water pump, and the controller controls an operation of the first water pump according to the second command.

9. The device for adding a fluid medium to a shower system according to claim 1, wherein an outer surface of at least one of the water pipe, the suction pipe, the valve body assembly or the bypass pipe is at least partially covered with an antimicrobial material.

10. The device for adding a fluid medium to a shower system according to claim 1, wherein the valve body assembly further comprises a second one-way valve for preventing a back flow of the fluid medium, and the second one-way valve is provided between the fluid medium inlet and the fluid medium outlet.

11. The device for adding a fluid medium to a shower system according to claim 1, wherein the three-way valve pipe comprises a venturi nozzle, wherein the water inlet pipe, the water return pipe and the water mixing pipe meet at a center, and the venturi nozzle is provided between the water inlet pipe and the center.

12. The device for adding a fluid medium to a shower system according to claim 11, wherein the three-way valve pipe is a venturi three-way valve pipe.

13. The device for adding a fluid medium to a shower system according to claim 12, wherein the fluid medium pipe assembly comprises a venturi switch, and the venturi switch is provided between the fluid medium inlet and the water return pipe, wherein the device comprises a fixing plate provided with a first groove portion, wherein the venturi switch comprises a first activation element, and the first activation element is disposed in the first groove portion and faces a left side face or a right side face of a box body.

14. The device for adding a fluid medium to a shower system according to claim 13, wherein the device further comprises a bottom plate, the bottom plate is provided with a second groove portion and a third groove portion, the water pipe is disposed in the second groove portion, and the three-way valve pipe is disposed in the third groove portion.

15. The device for adding a fluid medium to a shower system according to claim 1, wherein the device comprises a box body in which the fluid medium pipe assembly and the valve body assembly are disposed, wherein the reservoir is mounted to a bottom of the box body.

16. The device for adding a fluid medium to a shower system according to claim 15, wherein the bottom of the box body is provided with a through hole, and the reservoir is provided with a protrusion that is plug-fitted with the through hole.

17. The device for adding a fluid medium to a shower system according to claim 1, wherein the fluid medium comprises one or more fragrance medium, and the suction pipe is a flexible pipe.

18. A shower system, comprising a showerhead and a water source connector for introducing water, wherein a water inlet of the showerhead is in communication with a water outlet of the water source connector, wherein the shower system further comprises a device for adding a fluid medium to the shower system, wherein the device comprises:

a water pipe assembly comprising a water pipe, wherein the water pipe is provided with a water inlet and a water outlet, and the water inlet and the water outlet are configured to be connected with the shower system;

a reservoir for storing the fluid medium, wherein the reservoir comprising a first chamber and a second chamber which are separate from each other, the first chamber is configured to accommodate a first fluid medium, and the second chamber is configured to accommodate a second fluid medium different from the first fluid medium;

a fluid medium pipe assembly comprising a suction pipe and a switch valve, wherein the suction pipe is provided with a fluid medium inlet and a fluid medium outlet, and the fluid medium outlet is connected with the water pipe assembly, wherein the suction pipe comprises a communication portion, a first suction portion and a second suction portion, wherein a first end of the first suction portion extends into the first chamber, and a second end of the first suction portion is connected with a liquid inlet end of the communication portion, wherein a first end of the second suction portion extends into the second chamber, and a second end of the second suction portion is connected with the liquid inlet end of the communication portion, wherein the first end of the first suction portion and the second end of the second suction portion form the fluid medium inlet, and a liquid outlet end of the communication portion forms the fluid medium outlet, wherein the switch valve is configured to allow the communication portion to be selectively in communication with the first suction portion or the second suction portion;

a valve body assembly comprising a first water pump and a three-way valve pipe, wherein the water inlet is in communication with a water inlet pipe of the three-way valve pipe through the first water pump, a water return pipe of the three-way valve pipe is in communication with the fluid medium outlet, and a water mixing pipe of the three-way valve pipe is in communication with the water outlet, wherein the water pipe assembly further comprises a bypass pipe and a flow regulator, wherein a water inlet end of the bypass pipe is in communication with the water inlet and the water inlet pipe, and a water outlet end of the bypass pipe is in communication with the water outlet and the water mixing pipe, wherein the flow regulator is provided between the water inlet end of the bypass pipe and the water outlet end of the bypass pipe, wherein the water outlet of the water source connector is further in communication with the water inlet of the water pipe, and the water inlet of the showerhead is further in communication with the water outlet of the water pipe.

19. The shower system according to claim 18, further comprising a four-way valve pipe provided with a first water inlet, a first water outlet, a second water inlet and a second water outlet, wherein the first water inlet is in communication with the water outlet of the water source connector, the first water outlet is in communication with the water inlet of the water pipe, the second water inlet is in communication with the water outlet of the water pipe, and the second water outlet is in communication with the water inlet of the showerhead.

* * * * *